US005508893A

United States Patent [19]

Nowak et al.

[11] Patent Number: 5,508,893

[45] Date of Patent: Apr. 16, 1996

[54] MULTI-COLOR CHEMILUMINESCENT LIGHTING DEVICE AND METHOD OF MAKING SAME

[75] Inventors: Bogdon Nowak, Cranston, R.I.; Jacques Ladyjensky, Brussels, Belgium

[73] Assignee: Rhode Island Novelty Company, Inc., Warwick, R.I.

[21] Appl. No.: 195,515

[22] Filed: Feb. 8, 1994

[51] Int. Cl.[6] ..... F21K 2/00

[52] U.S. Cl. ..... 362/34; 362/104; 206/219

[58] Field of Search ..... 362/34, 159, 101, 362/84, 104; 206/569, 524.4, 229; 116/206; 43/17.5, 17.6; 252/700

[56] References Cited

U.S. PATENT DOCUMENTS

| | | | |
|---|---|---|---|
| 3,764,796 | 10/1973 | Gilliam et al. | 362/34 |
| 4,061,910 | 12/1977 | Rosenfeld | 362/34 |
| 4,638,584 | 1/1987 | Lindsay | 43/17.6 |
| 5,067,051 | 11/1991 | Ladyjensky | 362/34 |
| 5,158,349 | 10/1992 | Holland et al. | 362/34 |
| 5,325,273 | 6/1994 | Kuo | 362/34 |

*Primary Examiner*—Ira S. Lazarus
*Assistant Examiner*—Thomas M. Sember
*Attorney, Agent, or Firm*—Adam L. Brookman; Godfrey & Kahn

[57] ABSTRACT

A multi-colored chemiluminescent lighting device and method for making same comprising a flexible tube filled at least partially with an activator solution a plurality of ampules containing oxalate solutions, which may or may not be of the same density, wherein the ampules are disposed in the flexible tube and at least one barrier element disposed between at least two of the plurality of ampules, wherein the barrier element(s) are disposed between ampules capable of imparting different chemiluminescent colors.

11 Claims, 3 Drawing Sheets

MULTI-COLOR CHEMILUMINESCENT LIGHTING DEVICE AND METHOD OF MAKING SAME

FIELD OF THE INVENTION

The present invention relates generally to devices for producing chemiluminescent light, and more particularly to such devices emitting multiple colors of light.

BACKGROUND OF THE INVENTION

Devices which generate light by chemical means have existed for many years. The primary advantage to such devices is the generation of the light absent the generation of any consequential amount of heat. The uses of these devices have ranged from military (e.g., markers for shipwrecked seamen) to novelty (e.g., glow necklaces sold at fairs).

Formulas for creating chemiluminescent light are widely known and can be found in many patents originally assigned to American Cyanamid (e.g., U.S. Pat. No. 4,678,608). The construction of thin "ropes" or other flexible structures capable of emitting chemiluminescent light, on demand, are also well known.

Generally, chemiluminescent light is produced by the reaction of a catalyzed hydrogen peroxide solution with an oxalate solution. The main component of the oxalate solution is usually bis(6-carbopentoxy-2,4,5-trichlorophenyl)oxalate ("CPPO") which is mixed with dibutyl phthalate and a fluorescent dye (e.g., 9, 10 bis(phenylethynyl)anthracene). The hydrogen peroxide solution ("activator") typically includes a major portion of hydrogen peroxide, tertiary butanol, dimethyl phthalate and a catalyst (e.g., salicylate of sodium or other metal).

The fluorescent dye, present in the oxalate solution, is the ingredient which imparts color to the emitted light. Red, blue, pink, orange white and green are the most frequent colors imparted, depending upon the chosen dye.

The catalyst, included in the activator solution, functions as an initiator for the chemiluminescent reaction. Thus, the hydrogen peroxide solution and the oxalate solution must be kept apart until it is desired to generate light.

A typical chemiluminescent necklace is composed of two parts: an outside flexible plastic tube; and an inside frangible glass tube. Generally, the glass tube contains the oxalate solution and the plastic tube contains the activator solution. When the inner glass tube is broken, typically by bending the flexible plastic tube, the two components mix together and a chemical reaction takes place. This chemical reaction produces light of a particular color for a given length of time.

U.S. Pat. No. 5,158,349 discloses a multi-color chemical lighting device which purports to provide a plurality of colors, in a single flexible tube, without appreciable mixing of colors. The construction of this device is very straightforward, two or more frangible glass tubes ("ampules") are fitted, in a conventional manner, into an outer, flexible plastic tube. In at least an alternating pattern, the ampules contain dyes capable of causing the generation of different colored light. When the ampules are broken, a plurality of distinct color bands are initially created. Mixing of the color bands is stated to be avoided for diameters less than 0.3 inches, based on the discovery that "a critically long and narrow tube that is sealed at both ends can provide sufficient capillary wall resistance along the lateral mass of the reaction solution composition to practically preclude lateral admixing even under agitating conditions."

Studies of devices made in accordance with the teaching of U.S. Pat. No. 5,158,349 have revealed that, contrary to the statements in the specification, substantial mixing does occur, with and without agitation, when outer plastic tubes of inner diameters approaching 0.1 inches (2.5 mm) are employed. Thus, there is no prior art device which provides a multi-color chemiluminescent "rope" which maintains the colors in separate and distinct regions over time and after undergoing agitation.

SUMMARY OF THE INVENTION

It is an object of the present invention to provide an improved multi-color chemiluminescent necklace and method of making same.

It is another object of the present invention to provide a multi-colored chemiluminescent necklace which maintains the colors in separate and distinct regions over time and after undergoing agitation.

It is yet another object of the present invention to provide an improved multi-color chemiluminescent necklace which is inexpensive and simple to manufacture.

One embodiment of the present invention comprises an elongated, flexible outer tube of any diameter, filled with an activator solution, a plurality of glass ampules each filled with an oxalate solution and a dye, such that no adjacent ampules have a dye yielding the same color, and a partial barrier capable of impeding the mixing of adjacent color bands when the chemiluminescent necklace is activated.

Dividers, which preferably comprise barrier elements, are placed between ampules. These barrier elements may be plastic balls, steel balls, relatively short solid plastic cylinders or relatively short foamed plastic cylinders, or the like. Alternatively, a single long glass ampule separated into multiple chambers by melted glass or multiple ampules sealed at one end with a wax plug may be employed. It is also possible to provide similar results by "strangling" the diameter of the outer flexible tube between successive ampules.

In another embodiment of the present invention oxalate solutions of identical densities are employed in each color. With or without barriers, the employment of this embodiment of the present invention yields a marked improvement over the prior art.

In sum, the use of the above-described techniques substantially reduces the mixing between the color bands and results in an inexpensive, easy to assemble, superior commercial product.

DETAILED DESCRIPTION

Figure 1:
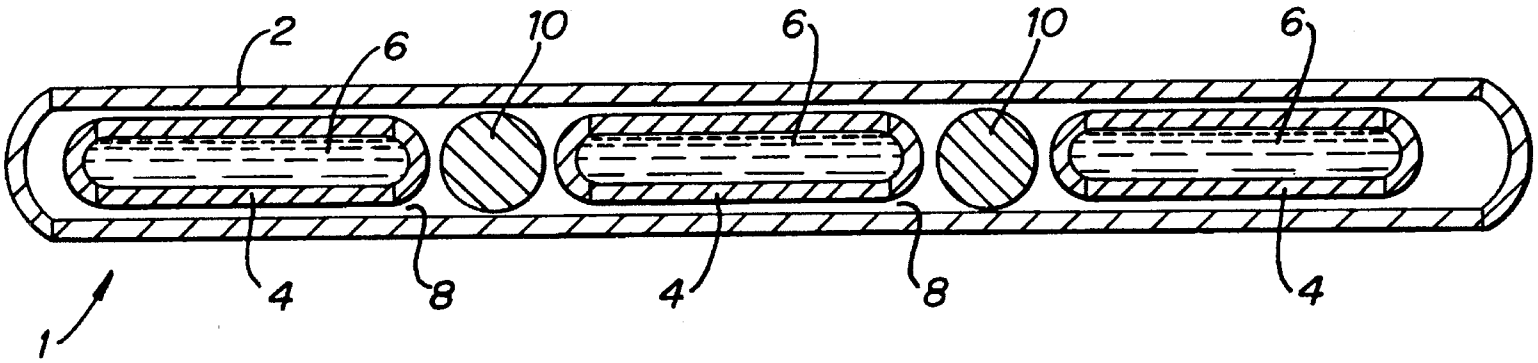
FIG. 1 is a cross-sectional view of one embodiment of the present invention.
Figure 2:
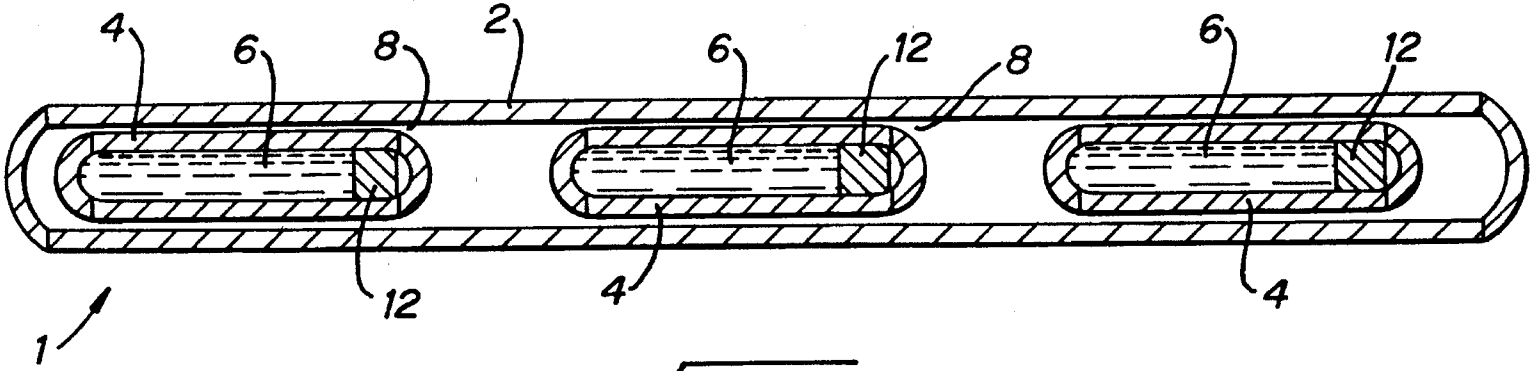
FIG. 2 is a cross-sectional view of a second embodiment of the present invention.
Figure 3:
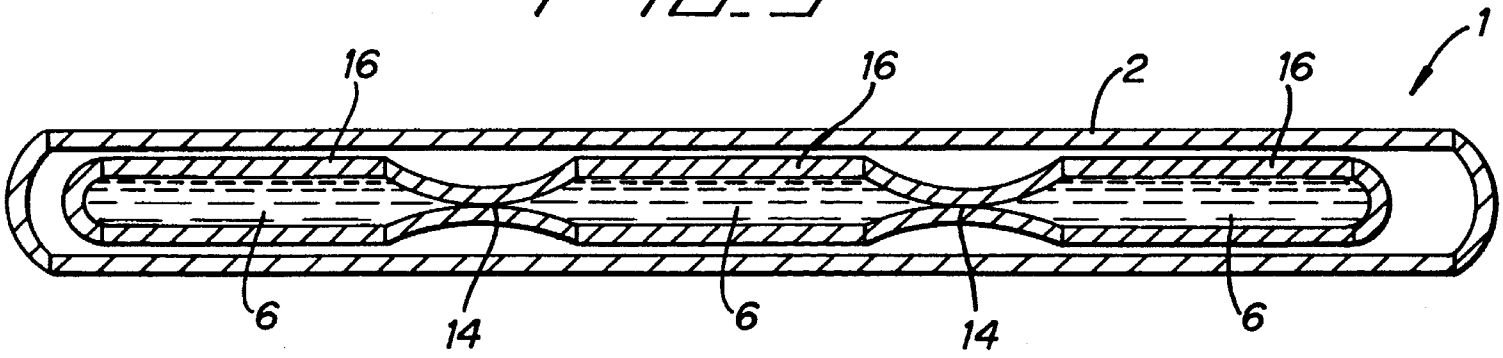
FIG. 3 is a cross-sectional view of a third embodiment of the present invention.

Referring to FIGS. 1–3, the device 1 of the present invention comprises an outer flexible tube 2 and plurality of ampules 5. (While FIGS. 1–4 show arrangements with three ampules, any number of ampules in excess of two may be employed).

The ampules 4 are filled with the oxalate solution 6, including the fluorescent dye. The outer flexible tube 2 is filled with the activator solution 8, which flows around each ampule 4.

Preferably, the outer flexible tube is made of a strong flexible plastic material such as polyethylene or polypropylene and has an internal diameter of between 2–10 mm and most preferably between 2.5–8 mm. Each ampule is preferably made of glass, but any material which can be easily breached by flexion will suffice.

Referring specifically to FIG. 1, a first embodiment of the present invention is shown. As can be seen, barrier elements 10, in the form of solid spheroids, are deployed between the ampules 4, within the flexible outer tube 2. The spheroids can be of any non-reactive material, but are preferably of plastic or metal. The spheroids are sized to approach the inner walls of the flexible outer tube 2, but with sufficient clearance to be inserted therein.

While the barrier elements 10, shown in FIG. 1, are in the form of solid spheroids, they need not be solid, nor spherical. Alternatively, hollow spheroids of plastic, metal or the like or cylindrical "plugs" of foam, rigid plastic or metal may be employed.

Figure 5:
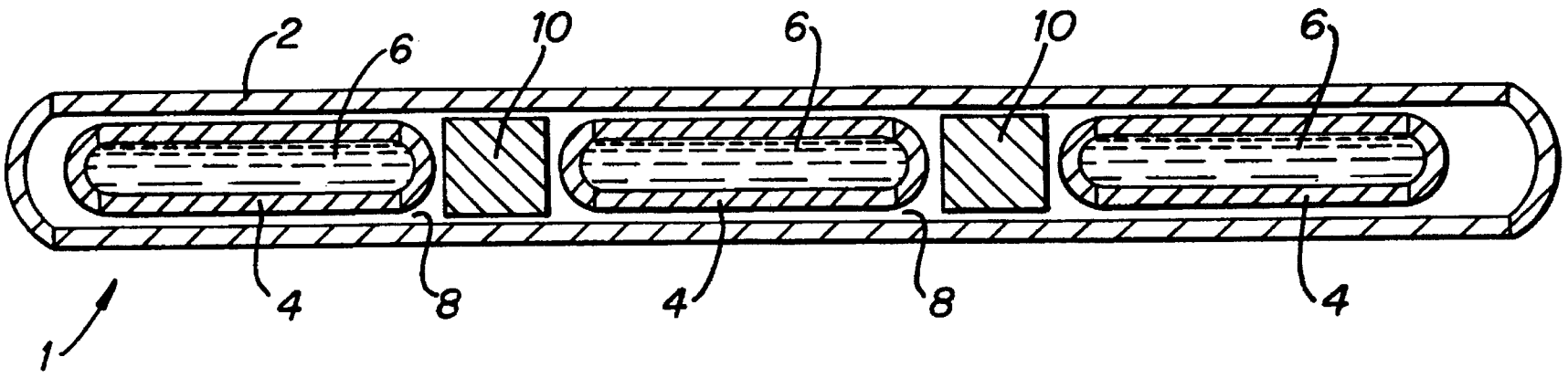
FIG. 5 is a cross-sectional view of a fifth embodiment of the present invention.

The first embodiment of the present invention is manufactured by first creating the ampules. A glass tube, with a first sealed end, is filled, by vacuum filling, with oxalate solution until the level of the oxalate solution approaches the tube's open end. Then the tube is sealed to complete the ampule. A plurality of ampules are prepared in this manner. Next, the ampules are introduced into a closed end plastic pipe filled with activator solution in alternating succession with solid spheroids, foam plugs (see FIG. 5) or the like. Then the open end of the plastic pipe is sealed.

Referring now specifically to FIG. 2, a second embodiment of the present invention is shown. In this embodiment, plugs, preferably made of wax, are placed inside the ampules 4 at one end. When the ampules are broken, the wax plugs stay attached to the end of ampule and act as a partial barrier element to impede the mixing of the adjacent chemiluminescent color bands. While wax is the preferred plug material for this embodiment, any moldable, non-reactive material (e.g. paraffin) will suffice.

As with the first embodiment, the preparation of a chemiluminescent necklace in accordance with the second embodiment begins with the preparation of the ampules containing the oxalate solution. In this instance, the glass tube is again vacuum filled with a quantity of oxalate solution. Then, the tube is centrifuged to push all the oxalate solution to one end. Next, a small dosed quantity of liquid wax is added, by vacuum filling, through the open end of the glass tube. The open end of the tube is sealed and the wax is allowed to harden. Finally, the ampules are inserted, in succession, into a flexible plastic pipe filled with activator solution. The plastic pipe is then sealed.

FIG. 3 shows a third embodiment of the present invention. In this embodiment a multiple chamber single ampule 16 is prepared. With this approach, a relatively small barrier element is created out of the solid glass sections 14 dividing the 16 ampule into chambers when the ampule is broken to generate the chemiluminescent light.

As with the second embodiment, a glass tube is filled with a quantity of oxalate solution and then centrifuged. The tube is then melted just above the point of maximum fill of the oxalate solution to create a first sealed chamber. Using the same tube, an additional quantity of oxalate solution is put in the glass tube and then subjected to centrifugation. The tube is then melted to create a second sealed chamber. This process continues until the tube length is exhausted or the desired number of sealed chambers is created. Finally, the single elongated, multi-chamber ampule is sealed inside a flexible plastic pipe.

Figure 4:
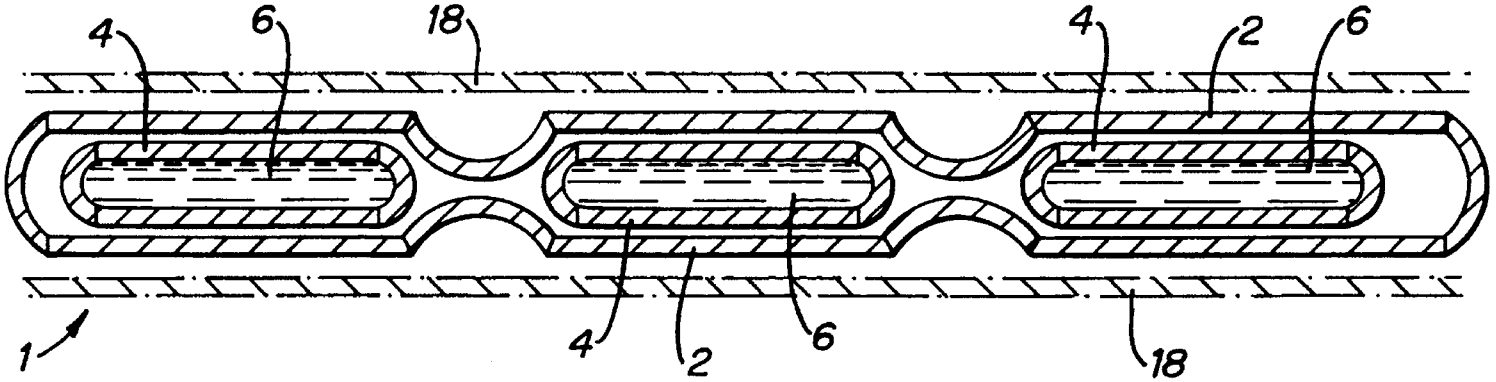
FIG. 4 is a cross-sectional view of a fourth embodiment of the present invention.

A fourth embodiment of the present invention, shown in FIG. 4, uses conventional ampules, but relies on a "strangulation" of the outer flexible tube, between the ampules, to act as a barrier element. A drawback to this approach is that the outward appearance of the necklace is marred but the area of strangulation. This problem can be addressed by the use of either sleeves fitted over the areas of strangulation (not shown) or by fitting the entire assembly inside yet another flexible tube 18.

The manufacture of a device in accordance with the fourth embodiment begins in the same manner as the manufacture of the first embodiment, namely, with the preparation of conventional ampules of oxalate solution. The ampules are inserted into a flexible plastic pipe in accordance with conventional chemiluminescent manufacturing technology. Thereafter, the necklace assembly is preferably placed in a heat-resistant glass or quartz tubular enclosure provided with radiant heating elements in the form of rings on its exterior wall. The rings are spaced to fall between the locations of the ampules. The heating enclosure is then closed and the necklace assembly is subjected to a compressed air environment. Finally, the radiant heating elements are activated and the flexible plastic tube is caused to undergo local "strangulation." If desired, when cool, the strangled necklace assembly can then be fitted into a secondary flexible sleeve to hide the effects of the strangulation.

In order to test the effectiveness of the present invention, a serious of tests were undertaken comparing traditional multi-color necklaces and the first embodiment of the present invention employing cylindrical foam plugs.

EXAMPLE 1

A tricolor chemiluminescent necklace, constructed in accordance with standard, barrier free technology, sold under the brand name, Magic in the Night®, was used as a reference. The necklace was 565 mm long with an exterior flexible translucent polyethylene tube of with an internal diameter of 2.6 mm and an external diameter of 5 mm. Three glass ampules, each 180 mm long, each having a diameter of 2.2 mm and each containing a 0.4 ml of blue, red and green oxalate solutions, respectively, were contained within the polyethylene tube. The necklace was activated by bending and breaking the inner glass. The intermixing of the blue and red liquids—resulting in a pink color—was then observed and measured over a four hour period. (Intermixing of the green and red colors was also noted, but not measured as it was substantially equal to the mixing of the red and blue liquids.) The results are shown below in Table 1.

TABLE 1

| TIME (minutes) | OBSERVED LENGTH OF MIXED AREA |
|---|---|
| 0 | 15 mm = 0.59" |
| 60 | 30 mm = 1.18" |
| 120 | 55 mm = 2.17" |
| 180 | 75 mm = 2.95" |

TABLE 1-continued

| TIME (minutes) | OBSERVED LENGTH OF MIXED AREA |
|---|---|
| 240 | 100 mm = 3.94" |

EXAMPLE 2

The same experiment as set forth in Example 1 was conducted but, immediately after activation the necklace was held in one hand, on one end, and rotated for one minute. It was then held by the other end and rotated for an additional minute. (This procedure mimics the agitation frequently carried out by purchasers of such products.) Again, the intermixing of the blue and red liquids was observed and measured. The results are shown below in Table 2.

TABLE 2

| TIME (minutes) | OBSERVED LENGTH OF MIXED AREA |
|---|---|
| 0 | 35 mm – 1.38" |
| 60 | 95 mm = 3.74" |
| 120 | 135 mm = 5.30" |
| 180 | 175 mm = 6.89" |
| 240 | 200 mm = 7.87" |

EXAMPLE 3

A necklace identical to those used in Examples 1 and 2 was taken and emptied of its contents. The original three ampules were also removed and carefully preserved with their contents intact. The necklace was then reassembled in a new flexible polyethylene tube 7 mm longer than the original tube but otherwise having the same dimensions. The tube was then refilled with the original activator solution and some additional extracted from other identical necklaces. Cylindrical rods of soft polyethylene foam of 3.5 mm in length and 2.6 mm in diameter were inserted between adjacent ampules. The necklace was then activated and the intermixing between the red and blue liquids observed for four hours. The results are shown below in Table 3.

TABLE 3

| TIME (minutes) | OBSERVED LENGTH OF MIXED AREA |
|---|---|
| 0 | 0 mm = 0" |
| 60 | 12 mm = 0.47" |
| 120 | 20 mm = 0.79" |
| 180 | 30 mm = 1.18" |
| 240 | 35 mm = 1.38" |

EXAMPLE 4

A necklace was prepared as in Example 3. However, immediately after activation, this necklace was agitated as set forth in Example 2. The intermixing between the red and blue liquids was observed and measured for four hours. The results are shown below in Table 4.

TABLE 4

| TIME (minutes) | OBSERVED LENGTH OF MIXED AREA |
|---|---|
| 0 | 10 mm = 0.39" |
| 60 | 35 mm = 1.38" |
| 120 | 50 mm = 1.97" |
| 180 | 65 mm = 2.56" |
| 240 | 75 mm = 2.95" |

EXAMPLE 5

A necklace identical to the ones employed in Examples 1 and 2 was taken and transformed to one of a larger size, i.e., the outer polyethylene tube was increased in outside diameter from 5 to 6 mm and the inside diameter was increased from 2.6 to 3 mm. The three ampules of 2.2 in diameter have been replaced with new ampules of 2.5 mm in diameter and filled with oxalate solutions extracted from other identical necklaces. The juxtaposition of the original ampules was maintained in the new, larger necklace. The new necklace was activated and the intermixing of the red and blue liquids was observed and measured for four hours. The results are shown below in Table 5.

TABLE 5

| TIME (minutes) | OBSERVED LENGTH OF MIXED AREA |
|---|---|
| 0 | 45 mm = 1.77" |
| 60 | 135 mm = 5.3" |
| 120 | 210 mm = 8.27" |
| 180 | 290 mm = 11.4" |
| 240 | 360 mm = 14.17" |

EXAMPLE 6

A necklace was prepared as in Example 5. However, immediately after activation, this necklace was agitated as set forth in Example 2. The intermixing between the red and blue liquids was observed and measured for four hours. The results are shown below in Table 6.

TABLE 6

| TIME (minutes) | OBSERVED LENGTH OF MIXED AREA |
|---|---|
| 0 | 180 mm = 7.09" |
| 60 | 220 mm = 7.87" |
| 120 | 260 mm = 10.24" |
| 180 | 300 mm = 11.81" |
| 240 | 360 mm = 14.17" |

EXAMPLE 7

A necklace was prepared as in Example 5, but with cylindrical foams barrier elements as used in Example 3. Again, the flexible polyethylene tube was lengthened by 7 mm to compensate for the displacement caused by the foam barrier elements. The intermixing between the red and blue liquids was observed and measured for four hours. The results are shown below in Table 7.

TABLE 7

| TIME (minutes) | OBSERVED LENGTH OF MIXED AREA |
|---|---|
| 0 | 0 mm = 0" |
| 60 | 15 mm = 0.59" |
| 120 | 25 mm = 0.98" |
| 180 | 35 mm = 1.38" |
| 240 | 40 mm = 1.57" |

EXAMPLE 8

A necklace was prepared as in Example 7. However, immediately after activation, this necklace was agitated as set forth in Example 2. The intermixing between the red and blue liquids was observed and measured for four hours. The results are shown below in Table 8.

TABLE 8

| TIME (minutes) | OBSERVED LENGTH OF MIXED AREA |
|---|---|
| 0 | 15 mm = 0.59" |
| 60 | 35 mm = 1.38" |
| 120 | 60 mm = 2.36" |
| 180 | 70 mm = 2.76" |
| 240 | 85 mm = 3.35" |

A comparison of the results obtained in the above-described examples is set forth below in Table 9.

TABLE 9

| | OBSERVED LENGTH OF MIXED AREA | | | | | | | |
|---|---|---|---|---|---|---|---|---|
| | 5 MM OUTSIDE DIAMETER | | | | 6 MM OUTSIDE DIAMETER | | | |
| TIME | No Barrier No Agitation | No Barrier Agitation | Barrier No Agitation | Barrier Agitation | No Barrier No Agitation | No Barrier Agitation | Barrier No Agitation | Barrier Agitation |
| 0 | 15 mm = 0.59" | 35 mm = 1.38" | 0 mm = 0" | 10 mm = .39" | 45 mm = 1.77" | 180 mm = 7.09" | 0 mm = 0" | 15 mm = 0.59" |
| 60 | 30 mm = 1.18" | 95 mm = 3.74" | 12 mm = 0.47" | 35 mm = 1.38" | 135 mm = 5.3" | 220 mm = 7.87" | 15 mm = 0.59" | 35 mm = 1.38" |
| 120 | 55 mm = 2.17" | 135 mm = 5.3" | 20 mm = 0.79" | 50 mm = 1.97" | 210 mm = 8.27" | 260 mm = 10.24" | 25 mm = 0.98" | 60 mm = 2.36" |
| 180 | 75 mm = 2.95" | 175 mm = 6.89" | 30 mm = 1.18" | 86 mm = 2.58" | 290 mm = 11.4" | 300 mm = 11.81" | 35 mm = 1.38" | 70 mm = 2.76" |
| 240 | 100 mm = 3.94" | 200 mm = 7.87" | 35 mm = 1.38" | 75 mm = 2.95" | 360 mm = 14.17" | 360 mm = 14.17" | 40 mm = 1.57" | 85 mm = 3.35" |

As can be clearly seen, the use of barrier elements in accordance with the present invention yielded dramatic improvements in the reduction of intermixing. In fact, in some instances, the reduction was higher than 85%.

Even without the use of barrier elements, the use of oxalate solutions of identical densities for each color, in accordance with another embodiment of the present invention, provides a significant diminution in the intermixing of the color bands. By way of example, it is possible to prepare a tri-colored chemiluminescent lighting element in accordance with the present invention by dissolving 110 grams of CPPO per liter of dibutyl phthalate solvent for each of the three colors. Then, less than 1.5 grams per liter of the appropriate dye is added to each portion of CPPO solution. When this embodiment is employed without barriers, the areas of intermixing are about double that of the foam barrier embodiment described above. This is still superior to ordinary, prior art devices. When this embodiment is employed with barriers, results superior to those with barriers alone are obtained.

While the present invention has been described with reference to specific embodiments, neither the exact described materials nor the specific structure mentioned should be construed as limiting since the disclosed embodiments are merely illustrative of the invention. One of skill in the art may alter the described embodiments without departing from the spirit or scope of the invention.

We claim:

1. A multi-colored chemiluminescent lighting device having substantially contiguous bands of different colored light comprising:

a flexible hollow tube filled at least partially with an activator solution;

a plurality of ampules containing oxalate solutions, wherein said ampules are disposed in said flexible tube; and at least one barrier element disposed between at least two of said plurality of ampules, wherein said barrier element(s) are disposed between ampules capable of imparting different chemiluminescent colors and wherein said barriers minimize the discontinuance of the colored light along a length of the device.

2. A device according to claim 1, wherein said barrier element(s) comprise cylindrical foam plugs.

3. A device according to claim 1, wherein said barrier element(s) comprise spheroids.

4. A device according to claim 3, wherein said barrier element(s) comprise solid metal balls.

5. A device according to claim 1, wherein said ampules are frangible glass tubes.

6. A device according to claim 1, wherein at least one of said ampules is sealed at at least one end with a wax plug.

7. A device according to claim 1, wherein said plurality of ampules comprises a single element divided into chambers.

8. A device according to claim 1, wherein said oxalate solutions in said plurality of ampules are of substantially identical densities.

9. A multi-colored chemiluminescent lighting device having substantially contiguous bands of different colored light comprising:

a flexible hollow tube filled at least partially with an activator solution;

a plurality of ampules containing oxalate solutions, wherein said ampules are disposed in said flexible tube and wherein said oxalate solutions are of substantially identical densities; and at least one barrier element disposed between at least two of said plurality of ampules, wherein said barrier element(s) are very small relative to an overall length of said tube and wherein said barrier element (s) are disposed between ampules capable of imparting different chemiluminescent colors.

10. A method of generating multi-colored chemiluminescent light without substantial mixing of colors comprising the steps of:

placing a plurality of ampules containing oxalate solutions into a flexible hollow tube at least partially filled with an activator solution;

interspersing barrier elements which restrict a fluid flow within said hollow tube between ampules containing different colored oxalate solutions;

flexing said flexible outer tube to break said ampules and release said oxalate solutions into contact with said activator solution.

11. A method according to claim 10, further comprising the step of preparing oxalate solutions of substantial equal densities for filling said plurality of ampules.

* * * * *